US005117732A

United States Patent [19]

Munzel et al.

[11] Patent Number: 5,117,732

[45] Date of Patent: Jun. 2, 1992

[54] RECEIVER COIL FOR A PROGRAMMABLE PROJECTILE FUZE

[75] Inventors: Klaus Munzel, Klingnau; Viktor Kalin, Einsiedeln, both of Switzerland

[73] Assignee: Oerlikon-Contraves AG, Zurich, Switzerland

[21] Appl. No.: 723,587

[22] Filed: Jul. 1, 1991

[30] Foreign Application Priority Data

Jul. 19, 1990 [CH] Switzerland ..... 02399/90

[51] Int. Cl.[5] ..... F42C 17/04

[52] U.S. Cl. ..... 89/6.5

[58] Field of Search ..... 89/6.5, 6, 1.1

[56] References Cited

U.S. PATENT DOCUMENTS 4,022,102 5/1977 Ettel ..... 89/6.5
4,080,869 3/1978 Karoyannis et al. ..... 89/6.5
4,087,774 5/1978 Beuchat ..... 336/73
4,862,785 9/1989 Ettel et al. ..... 89/6.5

FOREIGN PATENT DOCUMENTS 0300255 1/1989 European Pat. Off. .
2317825 2/1977 France .
618050 6/1980 Switzerland .

OTHER PUBLICATIONS

European Search Report and Annex.

*Primary Examiner*—David H. Brown
*Attorney, Agent, or Firm*—Sandler, Greenblum, & Bernstein

[57] ABSTRACT

In order to improve the inductive transmission of pulses from a transmitter coil to a receiver coil of a projectile fuze, an insert formed of a steel band is mounted between a coil and a coil core formed of aluminum. This insert shields the coil against eddy current fields.

7 Claims, 3 Drawing Sheets

Fig- 3A
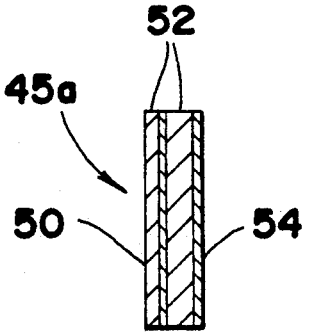
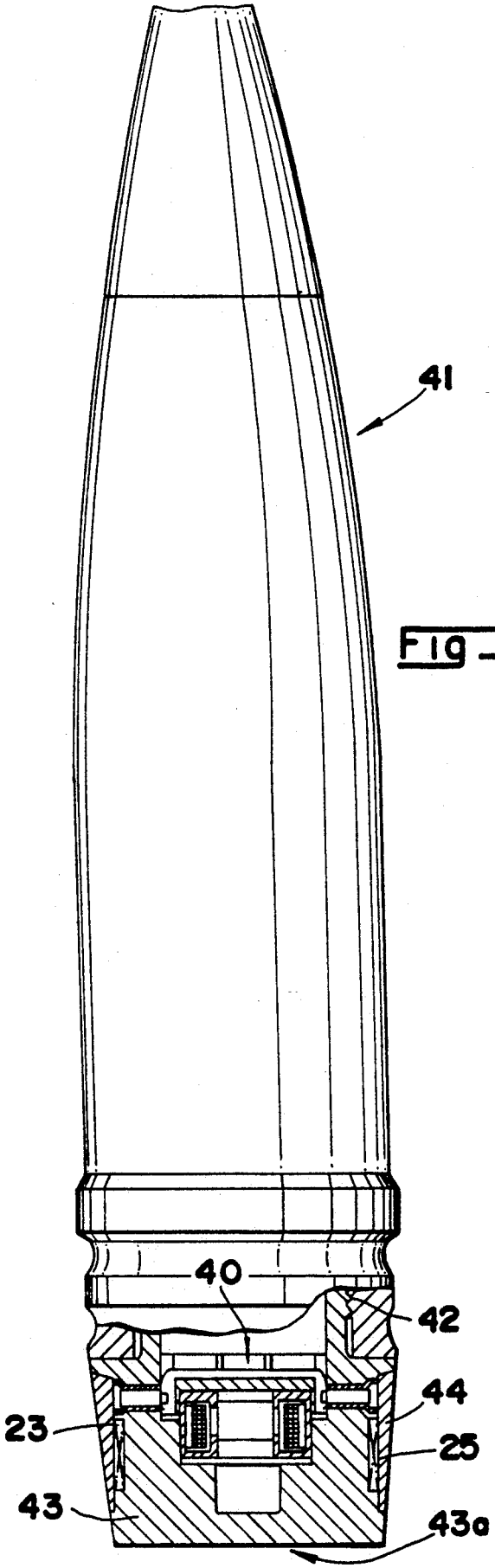
Fig- 2

RECEIVER COIL FOR A PROGRAMMABLE PROJECTILE FUZE

BACKGROUND OF THE INVENTION

1. Field of the Invention

The present invention relates to a new and improved receiver coil or receiver coil arrangement for a programmable projectile fuze comprising a coil core upon which there is located a winding or coil.

2. Discussion of the Background and Material Information

A programmable projectile fuze, for example as disclosed in the published European Patent Application No. 0,300,255, published Jan. 25, 1989 and the cognate U.S. Pat. No. 4,862,785, granted Sep. 5, 1989, comprises an apparatus for setting a counter for triggering a fuze, especially a delayed action or time fuze, located in the projectile after firing of such projectile. The counter is inductively set by a transmitter coil secured forwardly or downstream of the muzzle of the weapon by means of a receiver coil located within the projectile. There is also provided an apparatus for measuring the muzzle velocity of the projectile, in order to set or adjust the counter for triggering the delayed action fuze as a function of the muzzle velocity of the projectile. The receiver coil is mounted upon a coil body.

In order to be able to set or adjust the delayed action or time fuze with the requisite accuracy, at least 12 bits must be transmitted from the transmitter coil to the receiver coil. Assuming that the projectile has a muzzle velocity of, for example, about 1200 meters per second, then the flight of the receiver coil of the projectile through the transmitter coil secured at the muzzle of the weapon barrel occurs in a relatively short amount of time, so that only very little time is available for transmission of data or information from the transmitter coil to the receiver coil. Therefore, high frequencies are required for the transmission of such data or information.

It has now been found that with a coil core formed of steel, there is possible the transmission of this data from the transmitter coil to the receiver coil or receiver coil arrangement, but such results in an undesired increase in the weight of the projectile fuze. In order to reduce the weight of the projectile fuze in the projectile the coil core can be formed of aluminum. However, when this is done, then:

(a) the induced voltage in the case of an aluminum core is appreciably smaller than for an iron core; and (b) the positive and negative amplitudes of the induced voltage are asymmetrical in the case of an aluminum core and not of the same magnitude in opposite directions.

SUMMARY OF THE INVENTION

Therefore, it is a primary object of the present invention to provide an improved receiver coil arrangement for a programmable projectile fuze which is not afflicted with the aforementioned limitations and drawbacks.

Another and more specific object of the present invention aims at the provision of an improved receiver coil arrangement for a programmable projectile fuze which avoids the aforenoted drawbacks and protects the coil winding or coil of the projectile fuze against eddy current fields.

Still a further noteworthy object of the present invention concerns the provision of an improved receiver coil arrangement for a programmable projectile fuze which affords reliable transmission of data from the transmitter coil to the receiver coil arrangement with a fuze construction which nonetheless possesses relatively low weight.

Now in order to implement these and still further objects of the present invention, which will become more readily apparent as the description proceeds, the receiver coil or receiver coil arrangement for a programmable projectile fuze of the present development is manifested, among other things, by the features that an insert or insert member is arranged between the coil core and coil winding or coil which shields or screens the coil winding or coil against eddy current fields.

Preferably, an insert in the form of a thin, for instance, about 0.05 millimeter thick steel band is inserted between a coil winding or coil formed of copper and a coil core formed of aluminum. This steel band dampens the magnetic fields of the transmitter coil with such an intensity at the coil core formed of aluminum that there are generated practically no eddy currents. Eddy currents are likewise formed at the steel band, but such are appreciably smaller due to the greater eddy current resistance R (fe) of the iron.

The aforementioned insert or insert member composed of a steel band has two different functions:

(a) Owing to the ferro-electric properties of the steel band the magnetic lines of force are slightly compacted; and (b) The magnetic field lines occurring at the cylinder composed of the steel band induce therein eddy currents. These shield the coil carrier or core located therebelow such that practically no eddy currents are formed within the aluminum-coil carrier or core.

With proper dimensioning of the steel band the receiver coil arrangement of the present invention behaves in the manner of a coil mounted at a coil core formed of steel. As a result:

(a) The output voltage of the receiver coil appreciably increases with the same programmable current of the transmitter coil.

(b) The positive and negative amplitudes are of the same magnitude.

(c) When using a thin steel foil insulated at one side and having a number of convolutions or windings, it is possible to further reduce the eddy currents.

BRIEF DESCRIPTION OF THE DRAWINGS

The invention will be better understood and objects other than those set forth above, will become apparent when consideration is given to the following detailed description thereof. Such description makes reference to the annexed drawings wherein there are depicted different embodiments of receiver coils in conjunction with a programmable projectile fuze, and specifically wherein:

FIG. 2 is a longitudinal sectional view through a projectile according to a second embodiment;

2 serving for providing a detailed explanation of the present invention; and

FIG. 3A is an enlarged detail sectional view of a modified construction of insert member of the projectile fuze comprising a convoluted steel foil provided at one side or face with an electrically insulating layer.

DETAILED DESCRIPTION OF THE PREFERRED EMBODIMENTS

Describing now the drawings, it is to be understood that only enough of the construction of the receiver coil or receiver coil arrangement for a programmable projectile fuze and the associated muzzle of the weapon barrel have been depicted therein, in order to simplify the illustration, as needed for those skilled in the art to readily understand the underlying principles and concepts of the present invention.

Figure 1:
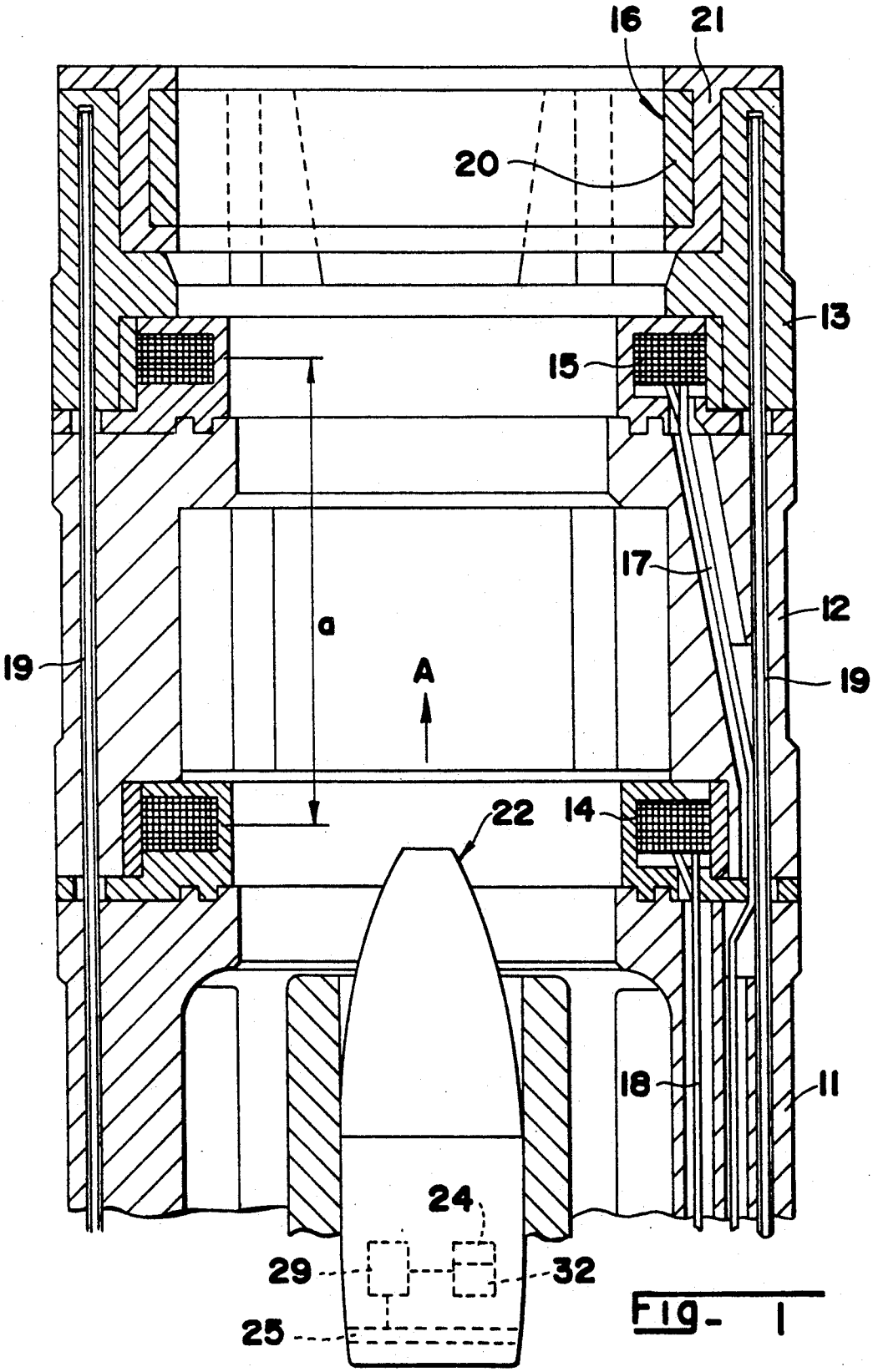
FIG. 1 illustrates a longitudinal sectional view through a muzzle of a weapon barrel equipped with an apparatus for measuring the muzzle velocity and with a transmitter coil for transmission of data or information to a projectile which departs from the weapon barrel muzzle.

Turning attention now to FIG. 1, it will be seen that the weapon barrel muzzle 10 is surrounded by a three-member cage or cage structure 11, 12 and 13 which protrudes beyond the weapon barrel muzzle 10. In the intermediate part 12 of the cage 11, 12 and 13 there is located a first measuring coil 14 and in the forward or downstream part 13 of this cage 11, 12 and 13 there is located a second measuring coil 15 and a transmitter coil 16. The conventional manner of attachment of the three-member cage 11, 12 and 13 at the weapon barrel muzzle 10 and the interconnection of the three members of such three-member cage 11, 12 and 13 with one another is well known in the art, and thus, need not be here additionally considered or illustrated, particularly since such does not constitute subject matter of the invention nor is the same necessary for understanding of the inventive concepts.

Lines or conductors 17 and 18 serve for supplying electrical energy to both of the measuring coils 14 and 15. A number of soft iron rods 19, of which only two are visible in the showing of FIG. 1, are incorporated within the three-member cage 11, 12 and 13 for shielding the entire measuring installation against spurious or disturbing effects due to magnetic fields. The transmitter coil 16 comprises a single winding 20 and a coil body 21. A projectile 22 moves in the direction of the arrow A through the apparatus for measuring the starting velocity of the projectile 22 and for transmitting data or information, in other words, this projectile 22 travels through both of the measuring coils 14 and 15 and also through the transmitter coil 16. As previously explained, this transmitter coil 16 comprises a single winding 20 and furthermore is relatively small.

In order to determine the starting- or muzzle velocity of the projectile 22 there is measured the time t required by the projectile 22 to move from the measuring coil 14 to the measuring coil 15. From the known spacing a between these two measuring coils 14 and 15 and this time t there can be computed the muzzle velocity $V_o = a/t$. When taking into account such muzzle velocity $V_o$ of the projectile 22 it is possible to compute the time required for the projectile 22 to reach the target. Consequently, a delayed action or time fuze 24 arranged in the projectile 22 can be adjusted or set such that the projectile 22 is ignited at the region of the target. The time needed by the projectile 22 to reach the target after exiting from the weapon barrel muzzle 10 is transmitted in digital form from the transmitter coil 16 to a receiver coil 25 located in the projectile 22. As is usually the case and known in the art, such transmission is accomplished by magnetic induction.

In order to set the delayed action fuze 24 with the requisite accuracy at least twelve pulses should be transmitted from the transmitter coil 16 to the receiver coil 25. As already explained, since the projectile 22 moves through the transmitter coil 16 with a velocity of approximately 1200 meters per second it is necessary to transmit the twelve pulses at a relatively high frequency at the proper point in time. The proper point in time for the transmission of the pulses is determined with the aid of the forward measuring coil 15 of the apparatus for measuring the muzzle velocity $V_o$. As soon as the projectile 22 has travelled through the measuring coil 15 there can be transmitted the data or information from the transmitter coil 16 to the receiver coil or receiver coil arrangement 25. The pulses arrive from the receiver coil 25 through a filter 29 at a counter 32 which is connected with the delayed action fuze 24. It is here remarked by way of completeness that circuitry for achieving the explained pulse transmission is well known in the art, as exemplified, for instance, by the aforementioned U.S. Pat. No. 4,862,785, granted Sep. 5, 1989, to which reference may be readily had and the disclosure of which is incorporated in its entirety by reference.

According to the modified showing of FIG. 2, a so-called base fuze 40 is threadably secured by threading 42 or equivalent connection means at the rear end of a projectile 41. The individual elements of the base fuze 40 are located internally of a fuze housing or casing **43*a* which also functions as a coil core 43*a* and forms in conjunction with a winding or coil 23 the previously mentioned receiver coil or receiver coil arrangement 25. An insulating layer 44 protects the winding or coil 23** against damage due to the presence of the hot propellant gases. The construction of the fuze is known to the art and thus need not be here further considered.

Figure 3:
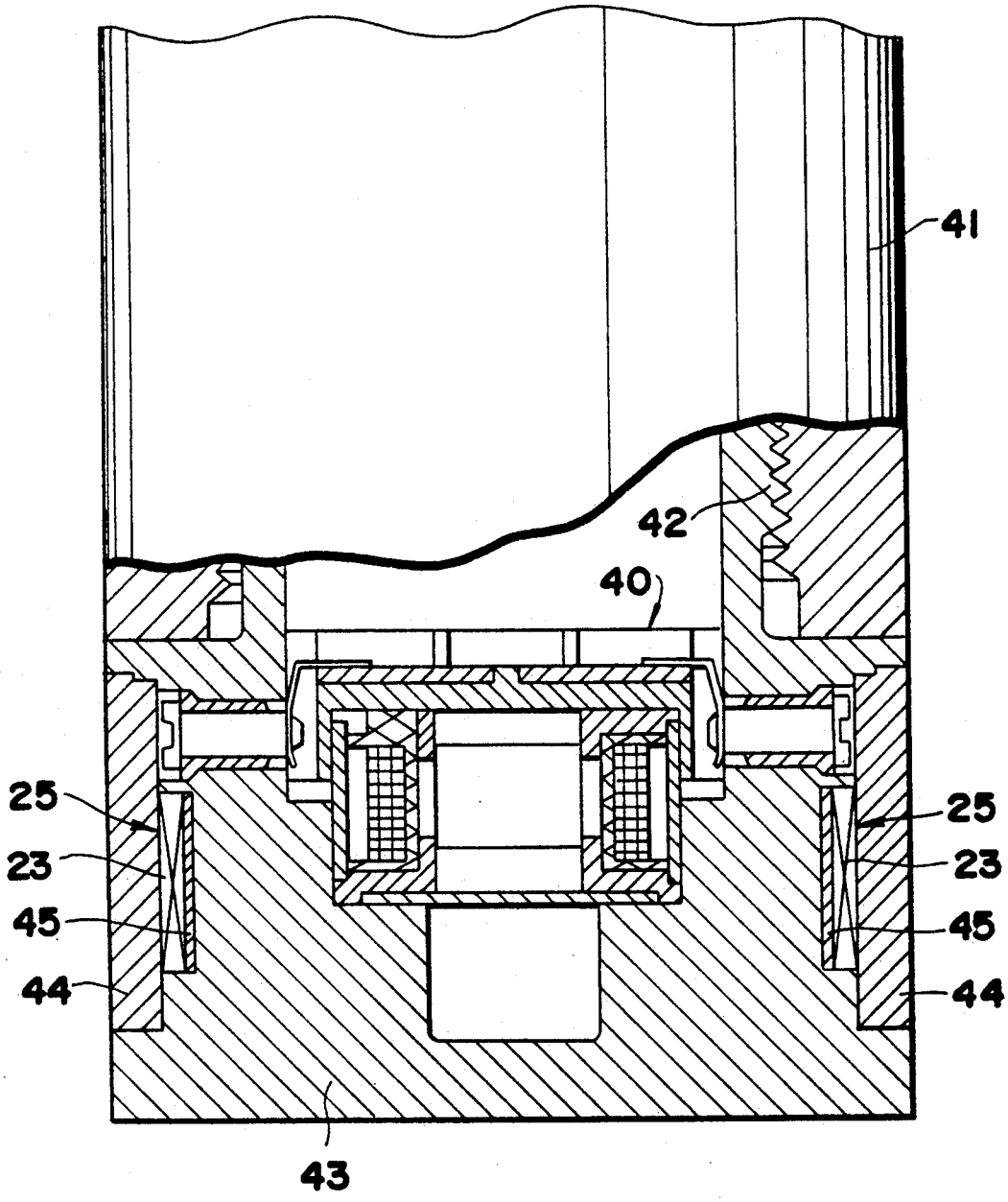
FIG. 3 is an enlarged longitudinal sectional view through the projectile fuze of the arrangement of FIG.

With reference now to FIG. 3 and considering at this point the present invention in detail, it will be seen that at the region of the receiver coil or receiver coil arrangement 25 an insert or insert member 45 is located between the coil or winding 23 formed, for instance, of copper wire and the coil core 15 43 formed of aluminum and defined by the fuze housing or casing **43*a*. This insert or insert member 45 preferably comprises a steel band, for example, formed of ferro-electric material having high permeability $\mu$ which is equal to or greater than 100. A steel band thickness of 0.05 mm. is sufficient to protect the coil or winding 23** against an eddy current field.

Moreover, and as shown for the modified construction depicted on an enlarged scale in FIG. 3A, this steel band of the insert or insert member **45*a* can comprise a one-sided insulated steel foil 50 possessing a number of convolutions or coils 52, wherein the electrically insulating layer 54** can be formed of a glass-fiber reinforced epoxy resin.

Instead of using a thin steel band there can be employed an appreciably thicker insert or insert member 45 formed of electrically insulating material, such as again a glass-fiber reinforced epoxy resin, to the extent that sufficient space is available. Due to the thus formed spacing between the copper wire and the aluminum core there is realized a similar effect.

While there are shown and described present preferred embodiments of the invention, it is distinctly to be understood the invention is not limited thereto, but may be otherwise variously embodied and practiced within the scope of the following claims.

What is claimed is:

1. A receiver coil arrangement for a programmable projectile fuze, comprising:

a coil core;

a coil arranged at the coil core;

the coil core being formed of aluminum; and an insert member arranged between the coil core and the coil for shielding the coil against eddy current fields.

2. The receiver coil arrangement for a programmable projectile fuze as defined in claim 1, wherein:

said insert member comprises an electrically insulating material.

3. The receiver coil arrangement for a programmable projectile fuze as defined in claim 2, wherein:

said electrically insulating material comprises a glass-fiber reinforced epoxy resin.

4. The receiver coil arrangement for a programmable projectile fuze as defined in claim 1, wherein:

said insert member comprises a steel band.

5. The receiver coil arrangement for a programmable projectile fuze as defined in claim 4, wherein:

said steel band is formed of ferro-electric material having high permeability.

6. The receiver coil arrangement for a programmable projectile fuze as defined in claim 5, wherein:

said high permeability of the steel band amounts to at least 100.

7. The receiver coil arrangement for a programmable projectile fuze as defined in claim 5, wherein:

said steel band comprises a one-sided electrically insulated steel foil containing a plurality of convolutions.

* * * * *